US007637764B2

(12) United States Patent
Yoneda et al.

(10) Patent No.: US 7,637,764 B2
(45) Date of Patent: Dec. 29, 2009

(54) WATERPROOF CONNECTOR

(75) Inventors: Takahiro Yoneda, Shizuoka-ken (JP); Ryo Sawada, Shizuoka-ken (JP); Masayuki Fukui, Shizuoka-ken (JP); Miki Koizumi, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/170,984

(22) Filed: Jul. 10, 2008

(65) Prior Publication Data

US 2009/0017659 A1 Jan. 15, 2009

(30) Foreign Application Priority Data

Jul. 12, 2007 (JP) ..... P2007-183597

(51) Int. Cl.
*H01R 13/52* (2006.01)

(52) U.S. Cl. ..... 439/275; 439/587

(58) Field of Classification Search ..... 439/274, 439/275, 279, 587, 588
See application file for complete search history.

(56) References Cited

U.S. PATENT DOCUMENTS 4,193,655 A * 3/1980 Herrmann, Jr. ..... 439/275
7,033,216 B2 * 4/2006 Ito ..... 439/587

FOREIGN PATENT DOCUMENTS

JP 2005-158595 6/2005

* cited by examiner

*Primary Examiner*—Tho D Ta
(74) *Attorney, Agent, or Firm*—Finnegan, Henderson, Farabow, Garrett & Dunner, L.L.P.

(57) ABSTRACT

In a waterproof connector, a mat seal and a rear grid are attached to a rear side of a connector housing. These mat seal and rear grid include terminal insertion openings and electric wire insertion openings, respectively, which communicate with terminal receiving chambers. Wire tubes are fitted to electric wires to which large female terminals are crimped, and are brought into elastically intimate contact with inner walls of large terminal insertion openings of the mat seal. Moreover, each of the wire tubes includes a protruding portion that protrudes rearward from the large terminal insertion opening of the mat seal and is located in the large electric wire insertion opening.

6 Claims, 7 Drawing Sheets

WATERPROOF CONNECTOR

CROSS REFERENCE TO RELATED APPLICATION

This application is based upon and claims the benefit of priority from Japanese Patent Application No. 2007-183597 filed on Jul. 12, 2007, the entire contents of which are incorporated herein by reference.

BACKGROUND OF THE INVENTION

1. Field of the Invention

The present invention relates to a waterproof connector.

2. Description of the Related Art

In a conventional water proof connector, it is known to use a wire tube in order to ensure sealing properties between each of electric wires and a mat seal. In this conventional waterproof connector, the mat seal and a rear grid are mounted on a rear side (when viewed from a corresponding connector) of a housing in this order. The electric wire is inserted into the wire tube with a substantially cylindrical shape. The electric wire inserted into the wire tube is inserted into a terminal receiving chamber of the housing through a terminal insertion opening of the rear grid and an electric wire insertion opening of the mat seal. In this state where the electric wire is inserted into the terminal receiving chamber, an outer circumferential surface of the wire tube is brought into intimate contact with an inner surface of the mat seal, and as a result, the sealing properties are ensured (refer to Japanese Patent Laid-Open Publication No. 2005-158595).

SUMMARY OF THE INVENTION

However, in the conventional waterproof connector, there has been a possibility to lose the sealing properties in a case where the electric wire is bent in the rear of the rear grid. Moreover, in this case, there have been possibilities that it may become difficult to pull out a terminal from the waterproof connector, and that the wire tube may separate therefrom at the time of pulling out the terminal.

The present invention has been made in order to solve such conventional problems as described above. It is an object of the present invention to provide a waterproof connector capable of ensuring the sealing properties and preventing difficulty pulling out the terminal therefrom even if the electric wire is bent, and of preventing the wire tube from separating therefrom at the time of pulling out the terminal.

A waterproof connector of the present invention includes: a connector housing fitted to a corresponding connector, the connector housing having a terminal receiving chamber that receives a terminal fitting; a mat seal having a terminal insertion opening formed at a position corresponding to the terminal receiving, the mat seal being attached to rear of the connector housing when viewed from the corresponding connector; a rear grid having an electric wire insertion opening formed at a position corresponding to the terminal insertion opening of the mat seal, the rear grid being attached from more rearward of the mat seal to a rear side of the connector housing to which the mat seal is attached; and a wire tube having a protruding portion, fitted to an electric wire having the terminal fitting attached thereto, and brought into elastically intimate contact with an inner wall of the terminal insertion opening of the mat seal. Moreover, the protruding portion is located in the electric wire insertion opening, and protrudes rearward from the terminal insertion opening of the mat seal.

Moreover, in the waterproof connector of the present invention, it is preferable that a diameter of the protruding portion be larger than diameters of other portions of the wire tube.

Furthermore, in the waterproof connector of the present invention, it is preferable that the protruding portion be formed of a material having higher rigidity than other portions of the wire tube.

Still further, in the waterproof connector of the present invention, it is preferable that the protruding portion be formed of a material having a smaller friction coefficient than other portions of the wire tube.

In accordance with the waterproof connector of the present invention, the wire tube has the protruding portion protruding rearward from the terminal insertion opening of the mat seal. Accordingly, even if the electric wire in the rear of the rear grid is bent, a rear side end portion of the wire tube will be thrust against the rear grid, and a situation can be prevented, where the rear side end portion is thrust against the mat seal, and the terminal insertion opening of the mat seal 7 is deformed largely. Moreover, the rear side end portion of the wire tube is prevented from being thrust against the mat seal, and accordingly, the rear side end portion is prevented from digging thereinto, and a situation where such an end portion is caught on the rear grid at the time of pulling out the terminal from the waterproof connector can be prevented. Hence, even if the electric wire is bent, sealing properties between the electric wire and the mat seal can be ensured, and it is prevented from becoming difficult to pull out the terminal, and further, the wire tube can be prevented from separating from the waterproof connector at the time of pulling out the terminal.

Moreover, the diameter of the protruding portion is increased more than the diameters of the other portions of the wire tube. Accordingly, the rigidity of the protruding portion is enhanced. In such a way, even if the electric wire in the rear of the rear grid is bent, the wire tube becomes less likely to be deformed, whereby a deformation amount of the terminal insertion opening can be suppressed. Moreover, since the diameter of the protruding portion is increased, the water can be further suppressed from entering the waterproof connector, whereby waterproof performance thereof can be enhanced.

Furthermore, the protruding portion is formed of the material having the higher rigidity than the other portions of the wire tube. Accordingly, even if the electric wire in the rear of the rear grid is bent, the wire tube becomes less likely to be deformed, whereby the deformation amount of the terminal insertion opening can be suppressed.

Still further, the protruding portion is formed of the material having the smaller friction coefficient than the other portions of the wire tube. Therefore, force of pulling out the terminal can be suppressed from becoming excessively large owing to friction between the protruding portion and the rear grid at the time of pulling out the terminal. In particular, in the case where the entirety of the wire tube is formed of a material having a small friction coefficient, the friction force between the wire tube and the mat seal is decreased, and a possibility that the wire tube may separate from the waterproof connector is increased; however, such a situation can be suppressed when only the protruding portion is formed of the material having the small friction coefficient.

DESCRIPTION OF THE EMBODIMENT

A description will be made of a preferred embodiment of the present invention based on the drawings.

Figure 1:
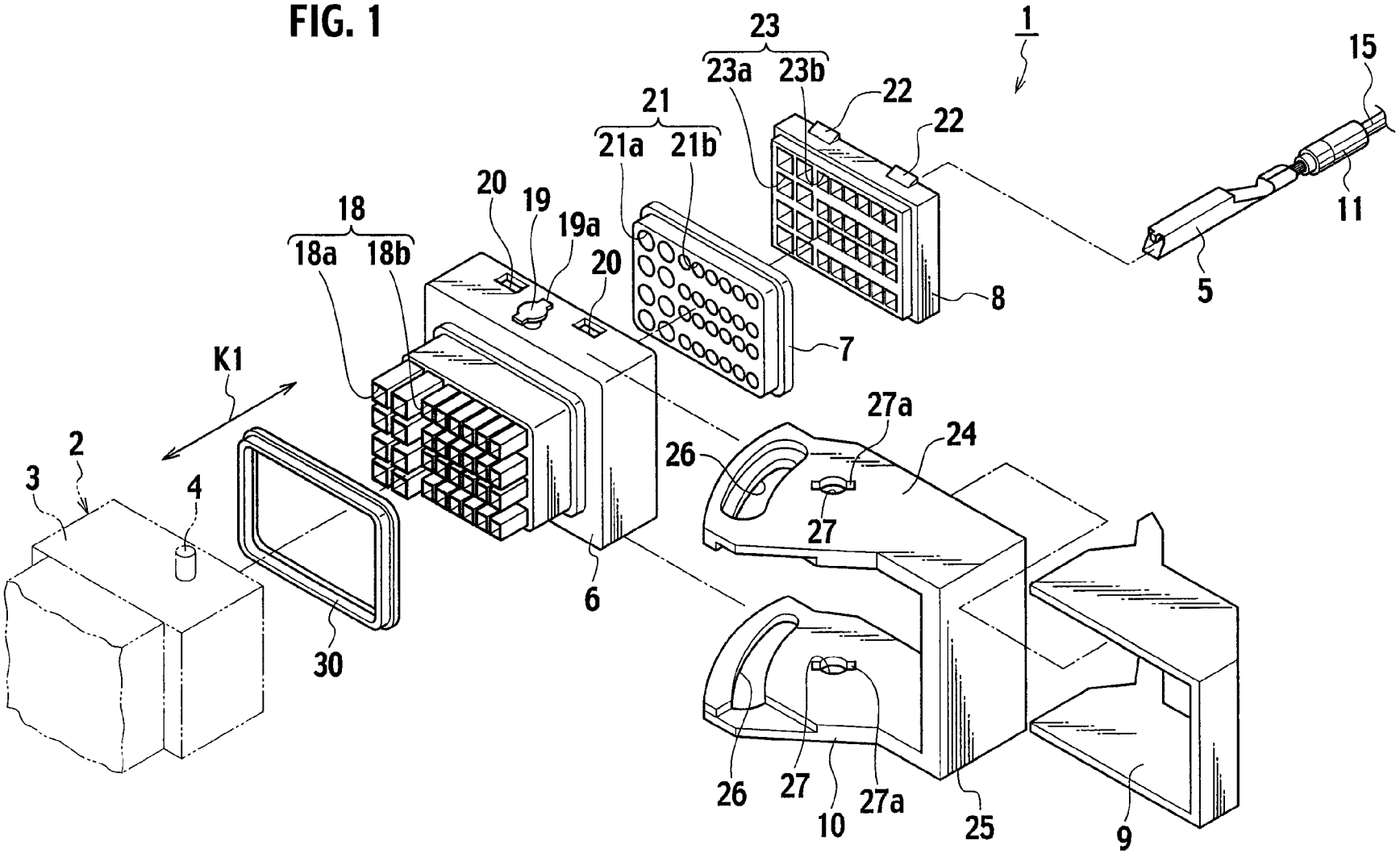
FIG. 1 is an exploded perspective view of a waterproof connector according to an embodiment of the present invention.

As shown in FIG. 1, a waterproof connector 1 is composed so as to be fitted and electrically connected to corresponding connector 2 (shown by chain double-dashed lines in FIG. 1).

The corresponding connector 2 includes: male-type terminal fittings (not shown, hereinafter referred to as male terminals); and a connector housing 3. Each of the male terminals is made of a conductive plate, and is crimped to a core wire of an electric wire.

The corresponding connector housing 3 is made of insulating synthetic resin and is formed into a tubular shape. The connector housing 3 has terminal receiving chambers which receive the male terminals. Moreover, protruding pins 4 are provided on the connector housing 3. Each of the protruding pin 4 protrudes outward of the connector housing 3 from an outer wall of the connector housing 3.

As shown in FIG. 1, the waterproof connector 1 includes: female-type terminal fittings (hereinafter referred to as female terminals) 5; a connector housing 6; a mat seal 7; a rear grid 8; a cover member 9; a lever member 10; and wire tubes 11.

Figure 2A:
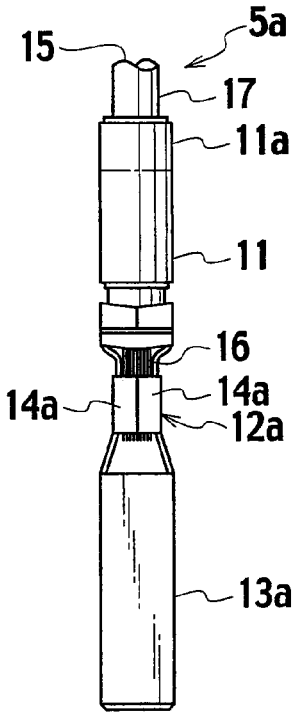
FIGS. 2A and 2B are plan views showing details of female terminals shown in FIG. 1.
Figure 2B:
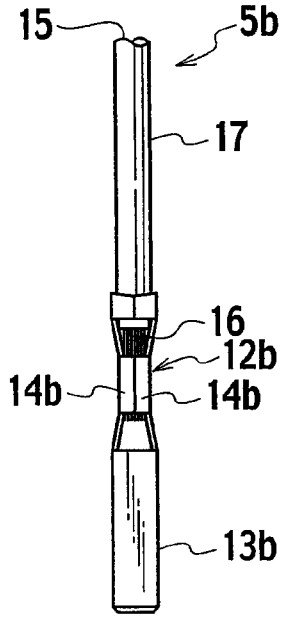

As shown in FIGS. 2A and 2B, the female terminals 5 according to this embodiment are composed of two types, which are large female terminals 5*a* and small female terminals 5*b*. Each of the large female terminals 5*a* is made of a conductive plate, and integrally includes an electric wire connecting portion 12*a* and an electric contact portion 13*a*.

The electric wire connecting portion 12*a* includes a plurality of crimping pieces 14*a*, and is electrically connected to an electric wire 15 in such a manner that the crimping pieces 14*a* crimp a core wire 16 of the electric wire 15. The electric contact portion 13*a* is formed into a cylindrical shape, and is electrically connected to the male terminal in such a manner that an electric contact portion of the male terminal enters an inside thereof. Moreover, a wire tube 11 with a cylindrical shape is fitted to a cover 17 of the electric wire 15 to which the large female terminal 5*a* is crimped. Specifically, the wire tube 11 is attached to the electric wire 15 in a state where the cover 17 of the electric wire 15 is brought into intimate contact with a hole portion of a cylindrical inside thereof.

In a similar way, the small female terminal 5*b* is made of a conductive plate, and integrally includes an electric wire connecting portion 12*b* and an electric contact portion 13*b*. In a similar way to the electric wire connecting portion 12*a* of the large female terminal 5*a*, the electric wire connecting portion 12*b* of the small female terminal 5*b* includes a plurality of crimping pieces 14*b*, and is electrically connected to an electric wire 15 in such a manner that these crimping pieces 14*b* crimp a core wire 16 of the electric wire 15. In a similar way to the electric contact portion 13*a* of the large female terminal 5*a*, the electric contact portion 13*b* is formed into a tubular shape, and is electrically connected to the male terminal in such a manner that an electric contact portion of the male terminal enters an inside thereof. Note that the wire tube 11 is not fitted to a cover 17 of the electric wire 15 to which the small female terminal 5*b* is crimped.

Figure 3:
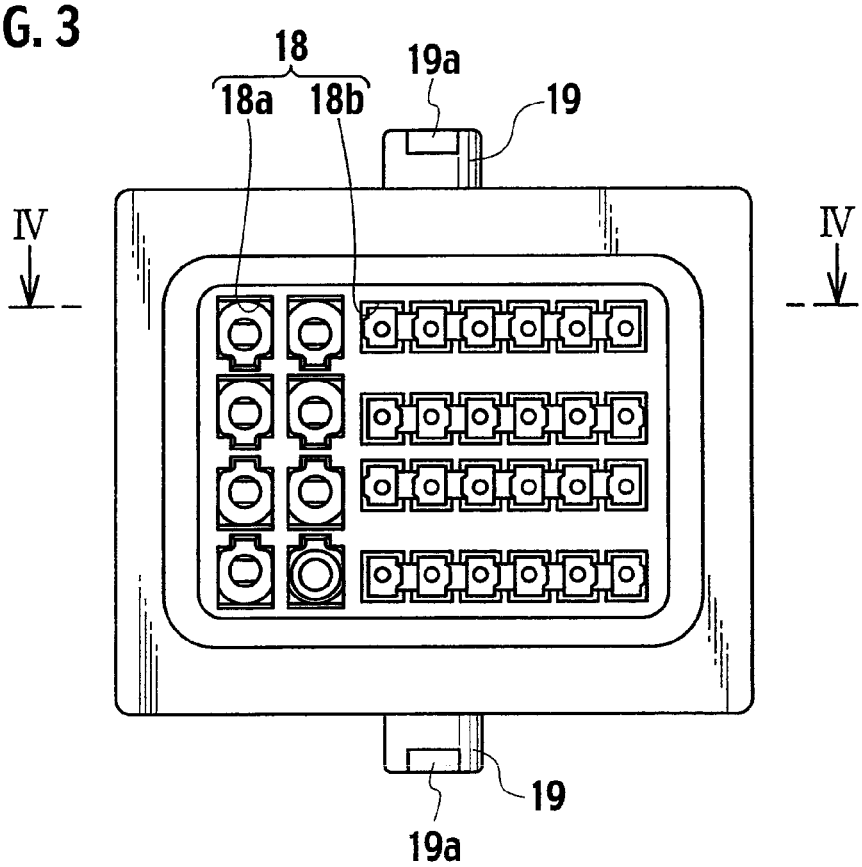
FIG. 3 is a front view of a connector housing shown in FIG. 1.

As shown in FIG. 1 and FIG. 3, the connector housing 6 is made of insulating synthetic resin, and includes a plurality of terminal receiving chambers 18. The terminal receiving chambers 18 are extended linearly, and are arranged parallel to one another. The terminal receiving chambers 18 are composed of large terminal receiving chambers 18*a* and small terminal receiving chambers 18*b*. The large terminal receiving chambers 18*a* receive the large female terminals 5*a*, and the small terminal receiving chambers 18*b* receive the small female terminals 5*b*.

Moreover, onto a front side (when viewed from the corresponding connector 2) of the connector housing 6, the above-described corresponding connector 2 is fitted while interposing a gasket 30 therebetween. The connector housing 6 and the corresponding connector 2 approach each other along an arrow K1 and are fitted to each other. The arrow K1 indicates a direction where the connector housing 6 and the corresponding connector 2 approach each other and are fitted to each other.

Furthermore, the connector housing 6 includes lever supporting protrusions 19 and engagement holes 20. Each of the lever supporting protrusions 19 is formed into a columnar shape, and protrudes outward of the connector housing 6 from an outer wall of the connector housing 6. Moreover, the lever supporting protrusion 19 has a protruding piece 19*a* for setting an initial position of the lever member 10. The protruding piece 19*a* is extended from the lever supporting protrusion 19 along the arrow K1. The engagement holes 20 are provided so as to penetrate a rear-side outer wall of the connector housing 6, and play a role to hold the connector housing 6 and the rear grid 8 in an engaged state.

The mat seal 7 includes: a bag-like skin made of an elastic material such as rubber; and a gel-state silicon resin as an elastic material filled into the skin. The mat seal 7 is formed into a flat plate shape. The mat seal 7 is composed so as to be attached onto the rear of the connector housing 6. Moreover, in the mat seal 7, a plurality of terminal insertion openings 21 are formed at positions corresponding to the plurality of terminal receiving chambers 18. The terminal insertion openings 21 penetrate through the mat seal 7, and are adapted to communicate with the terminal receiving chambers 18 in a state where the mat seal 7 is attached to the connector housing 6. More specifically, the terminal insertion openings 21 are composed of large terminal insertion openings 21*a* and small terminal insertion openings 21*b*. The large terminal insertion openings 21*a* communicate with the large terminal receiving chambers 18*a*, and the small terminal insertion openings 21*b* communicate with the small terminal receiving chambers 18*b*.

The rear grid 8 is made of insulating synthetic resin, and is formed of a material having higher rigidity than the material of the mat seal 7. This rear grid 8 is composed so as to be attached from more rearward of the mat seal 7 to the rear side of the connector housing 6 to which the mat seal 7 is attached. Moreover, the rear grid 8 is formed into a flat plate shape, and includes a plurality of engagement protrusions 22. The engagement protrusions 22 engage with the engagement holes 20 of the connector housing 6, whereby the rear grid 8 is attached to the rear side of the connector housing 6.

Moreover, the rear grid 8 includes a plurality of electric wire insertion openings 23 at positions corresponding to the terminal insertion openings 21 of the mat seal 7. The electric wire insertion openings 23 penetrate through the rear grid 8, and communicate with the terminal receiving chambers 18 and the terminal insertion openings 21 in a state where the rear grid 8 is attached to the connector housing 6. More specifically, the electric wire insertion openings 23 are composed of large electric wire insertion openings 23*a* and small electric wire insertion openings 23*b*. The large electric wire insertion openings 23*a* communicate with the large terminal receiving chambers 18*a* and the large terminal insertion openings 21*a*, and the small electric wire terminal insertion openings 23*b* communicate with the small terminal receiving chambers 18*b* and the small terminal insertion openings 21*b*.

The electric wires 15 to which the large female terminals 5*a* are attached are inserted into the large electric wire insertion openings 23*a* as described above, and the large female terminals 5*a* will reach the large terminal receiving chambers 18*a* through the large electric wire insertion openings 23*a* and the large terminal insertion openings 21*a*. Meanwhile, the electric wires 15 to which the small female terminals 5*b* are attached are inserted into the small electric wire terminal insertion openings 23*b*, and the small female terminals 5*b* will reach the small terminal receiving chambers 18*b* through the small electric wire terminal insertion openings 23*b* and the small terminal insertion openings 21*b*.

The cover member 9 covers the mat seal 7 and the rear grid 8, and is attached to the rear side of the connector housing 6. This cover member 9 houses the electric wires 15, which are attached to the female terminals 5, so that a mechanical load cannot be applied to the electric wire connecting portions 12 of the female terminals 5 received in the terminal receiving chambers 18.

The lever member 10 includes: a pair of plate portions 24; a link portion 25; cam holes 26; and protrusion receiving holes 27. Each of the plate portions 24 is formed into a flat shape plate, in a center of which the protrusion receiving hole 27 is provided. The lever supporting protrusion 19 enters the protrusion receiving hole 27. Moreover, the protrusion receiving hole 27 has notched portions 27*a* so as to allow the protruding pieces 19*a* to enter the notched portions 27*a* concerned. The lever member 10 is attached to the connector housing 6 so that the protruding pieces 19*a* and the notched portions 27*a* can correspond to each other, whereby the lever member 10 is set at the initial position.

Moreover, in such a state where the lever member 10 is attached to the connector housing 6, the plate portions 24 are laid on the outer walls of the connector housing 6, and become freely rotatable about the lever supporting protrusions 19. The link portion 25 is a portion that links the pair of plate portions 24 to each other. The link portion 25 is operated by an operator or the like. Each of the cam holes 26 is provided so as to penetrate the plate portion 24 along a circumferential direction taking the protrusion receiving hole 27 as a center. Moreover, the cam hole 26 allows the protruding pin 4 of the corresponding connector 2 to enter the same. Moreover, the cam hole 26 extends in a direction of gradually approaching the protrusion receiving hole 27 as going from an outer edge of the plate portion 24 to a center thereof. Specifically, the cam hole 26 is formed in the circumferential direction while approaching the lever supporting protrusion 19 serving as a rotation center.

When the operator or the like rotationally operates the lever member 10 as described above, an outer circumference-side surface of the cam hole 26 and the protruding pin 4 will slide to each other. Moreover, the cam hole 26 extends in the direction of approaching the lever supporting protrusion 19 as the rotation center, and accordingly, force of approaching the connector housing 6 will be applied to the corresponding connector 2. In such a way, the operator or the like can fit the corresponding connector 2 and the connector housing 6 to each other. Note that large force is not required for the operation of the lever member 10 because of the leverage, and the corresponding connector 2 and the connector housing 6 are easily fitted to each other.

Figure 4:
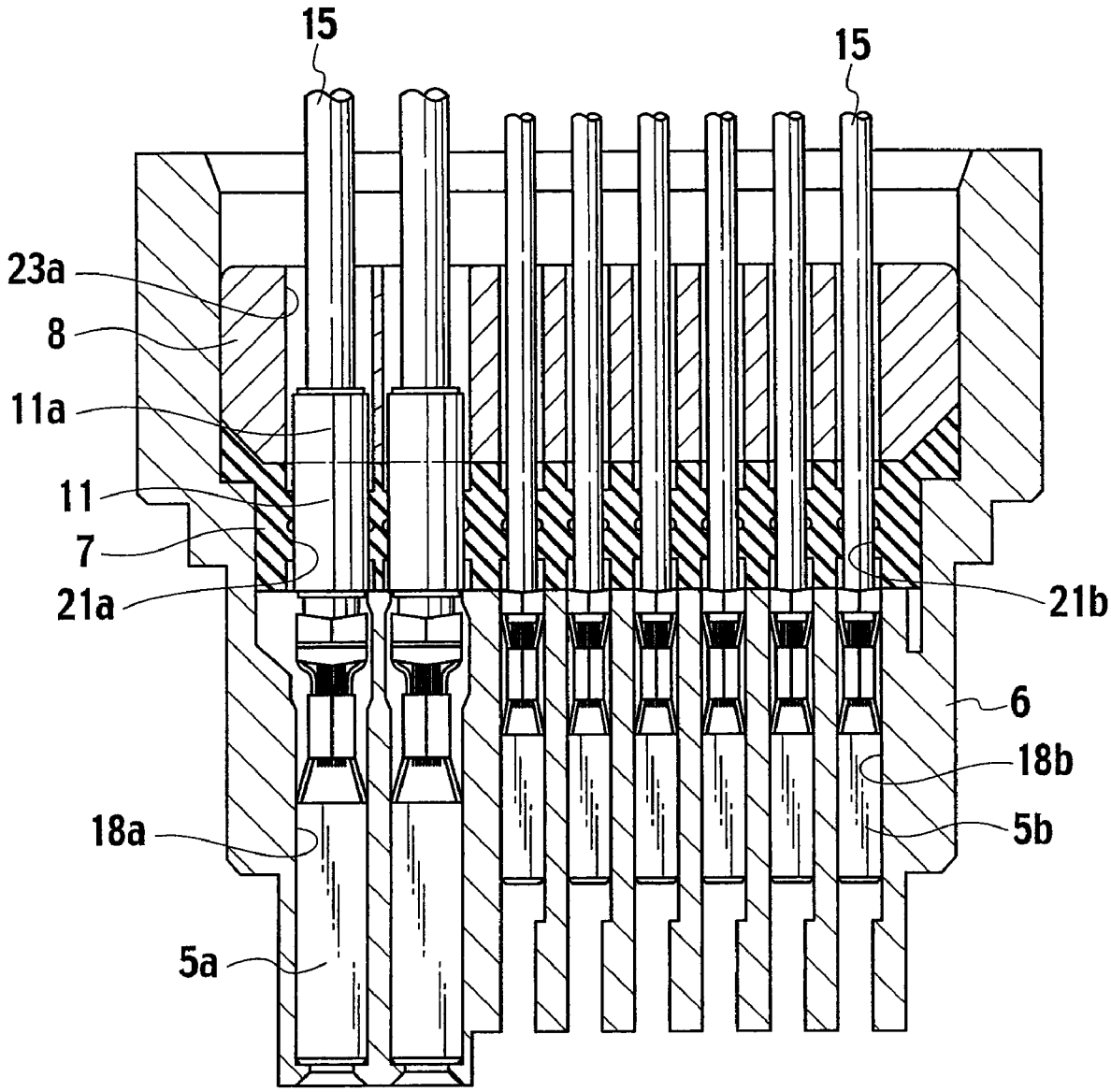
FIG. 4 is a cross-sectional view showing an attachment state where the female terminal shown in FIG. 2 is attached into each of terminal receiving chambers.

FIG. 4 is a cross-sectional view showing an attachment state where the female terminal 5 shown in FIG. 2 is attached into each of the terminal receiving chambers 18. Note that FIG. 4 shows a cross section taken along a line IV-IV of FIG. 3. As shown in FIG. 4, each of the wire tubes 11 is formed of an elastic material such as rubber, and is fitted to the electric wire 15 to which the large female terminal 5*a* is crimped. Moreover, in a state where the large female terminal 5*a* is received into the large terminal receiving chamber 18*a*, the wire tube 11 is adapted to be brought into elastically intimate contact with an inner wall of the large terminal insertion opening 21*a*. In such a way, waterproof performance is ensured. Note that, though the wire tube 11 is not fitted to each of the electric wires 15 to which the small female terminals 5*b* are crimped, the waterproof performance is ensured since an inner wall of each of the small terminal insertion openings 21*b* is brought into intimate contact with the electric wire 15.

In particular, the wire tube 11 according to this embodiment includes a protruding portion 11*a* protruding rearward from the large terminal insertion opening 21*a* of the mat seal 7. Specifically, the wire tube 11 is formed to be longer in the longitudinal direction than the large terminal insertion opening 21*a*, and becomes longer than a thickness of the mat seal 7. Therefore, the protruding portion 11*a* will be located in the large electric wire insertion opening 23*a* of the rear grid 8.

Next, a description will be made of an assembly method of the waterproof connector 1 according to this embodiment and a fitting method of the waterproof connector 1 and the corresponding connector 2. First, the operator or the like attaches the mat seal 7 to the rear side of the waterproof connector 1. Subsequently, the operator or the like attaches the rear grid 8 to the rear side of the mat seal 7. At this time, the operator or the like attaches the rear grid 8 to the mat seal 7 so that the engagement protrusions 22 of the rear grid 8 can be engaged with the engagement holes 20 of the connector housing 6.

Next, the operator or the like inserts the lever supporting protrusion 19 into the protrusion receiving holes 27 of the lever member 10. Thereafter, the operator or the like inserts each of the electric wires 15, to which the large female terminal 5*a* is crimped and the wire tube 11 is fitted, into the large electric wire insertion opening 23*a*. Then, the operator or the like pushes the electric wire 15 until the large female terminal 5*a* reaches the large terminal receiving chamber 18*a*. In such a way, a state where a lance (not shown) is caught on the large female terminal 5*a* is brought, and the electric wire 15 is prevented from being disconnected from the large electric wire insertion opening 23*a*. Moreover, the operator or the like inserts each of the electric wires 15, to which the small female terminal 5*b* is crimped, into the small electric wire insertion opening 23*b*. Then, the operator or the like pushes the electric wire 15 until the small female terminal 5*b* reaches the small terminal receiving chamber 18*b*. In such a way, a state where a lance (not shown) is caught on the small female terminal 5*a* is brought, and the electric wire 15 is prevented from being disconnected from the small electric wire insertion opening 23*b*.

Subsequently, the operator or the like attaches the cover member 9 to the connector housing 6. Next, the operator or the like stores the protruding pins 4 of the corresponding connector 2 into the cam holes 26, and thereafter rotates the lever member 10. In such a way, the connectors 1 and 2 will approach each other, and will be fitted to each other. Note that, in such a state where the connectors are fitted to each other, the lever member 10 is positionally fixed by a predetermined engagement member and the like of the cover member 9.

Figure 5:
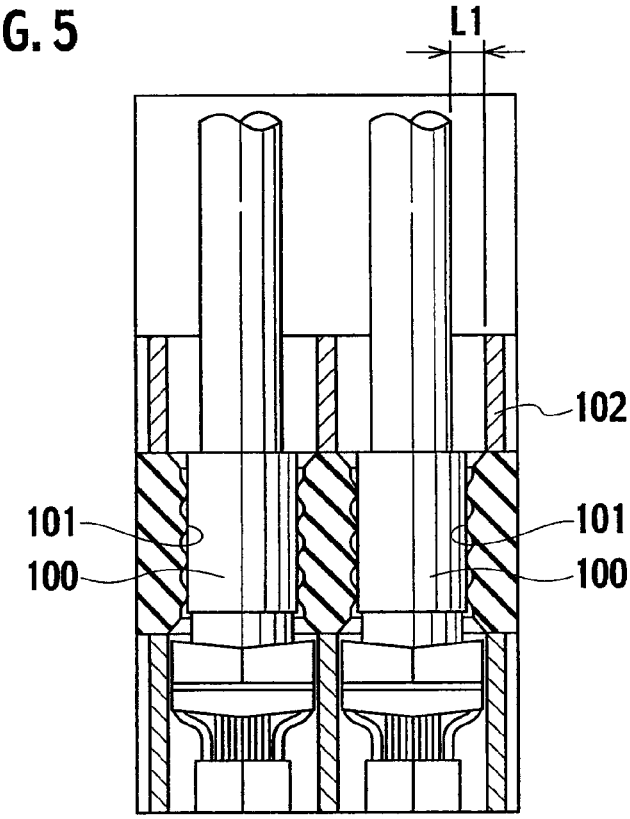
FIG. 5 is a first cross-sectional view showing a state of wire tubes and terminal insertion openings, which are according to a conventional waterproof connector.
Figure 6:
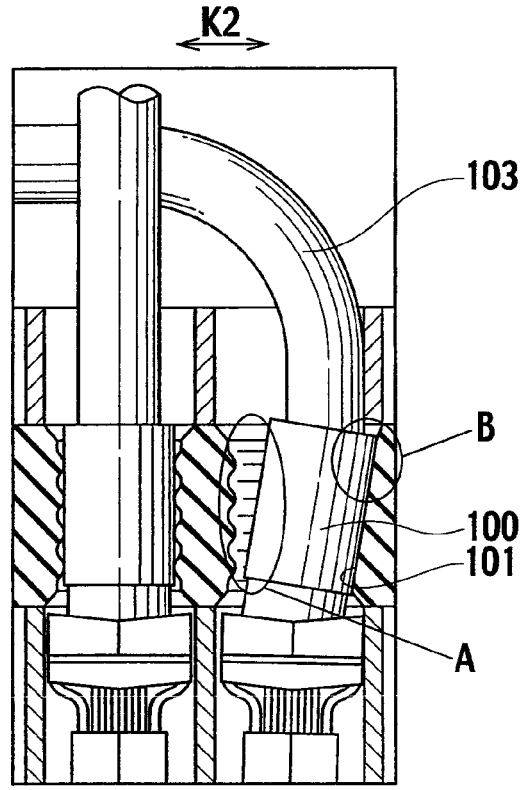
FIG. 6 is a second cross-sectional view showing the state the wire tubes and the terminal insertion openings, which are according to the conventional waterproof connector.

Next, prior to making a description of a function of the waterproof connector 1 according to this embodiment, a description will be made of states of wire tubes and terminal insertion openings, which are according to the conventional waterproof connector. FIGS. 5 and 6 are cross-sectional views showing the states of the wire tubes and the terminal insertion openings, which are according to the conventional waterproof connector. In a usual state, each of wire tubes 100 is brought into intimate contact with a terminal insertion opening 101, and accordingly, the waterproof performance in the terminal insertion opening 101 is ensured. Note that, in such a usual waterproof connector, an inner diameter of the rear grid 102 is made larger than outer diameters of the female terminal and the wire tube 100 in order to make it easy to push the female terminal into the terminal receiving chamber. Accordingly, as shown in FIG. 5, in the conventional waterproof connector, a gap L1 in which an electric wire 103 moves in the rear grid 102 is increased.

Here, as shown in FIG. 6, it is assumed that the electric wire 103 in the rear of the rear grid is bent with respect to a direction of inserting the electric wire. In this case, the electric wire 103 will move in the gap L1, the wire tube 100 is thrust against the terminal insertion opening 101, and a gap occurs between the wire tube 100 and the terminal insertion opening 101 (refer to a portion A of FIG. 6). Therefore, the waterproof performance is decreased. Moreover, by the fact that the wire tube 100 is thrust against the terminal insertion opening 101, a rear side end portion of the wire tube 100 will dig into the terminal insertion opening 101 having elasticity (refer to a portion B of FIG. 6). Accordingly, in the case of pulling out the terminal from the waterproof connector, the rear side end portion of the wire tube 100 is caught on the terminal insertion opening 23*a*, causing possibilities that it may become difficult to pull out the terminal from the waterproof connector concerned, and that the wire tube may separate therefrom at the time of pulling out the terminal. In particular, in a connector including such a cover member, since the electric wire 103 is cabled in a K2 direction of being bent from such an electric wire insertion direction, the problems of the above-described gap and catching become significant.

Figure 7:
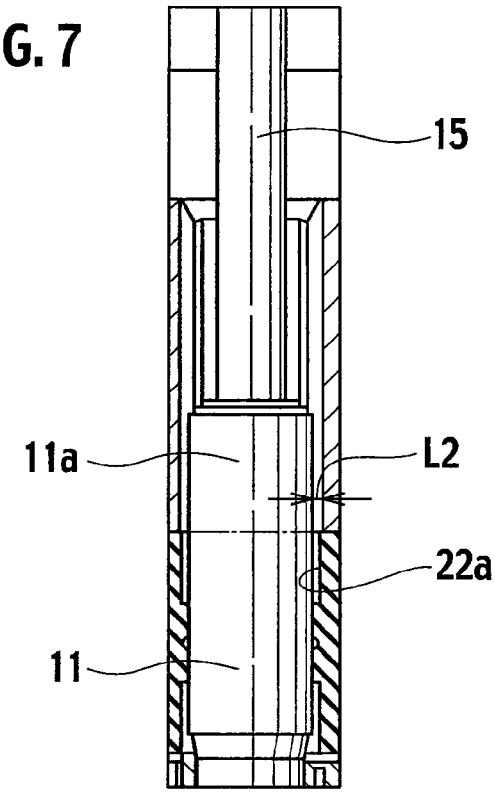
FIG. 7 is a first cross-sectional view showing a function of the waterproof connector according to the embodiment of the present invention.

As shown in FIG. 7, the wire tube 11 according to this embodiment includes the protruding portion 11*a* protruding rearward from the large terminal insertion opening 21*a* of the mat seal 7. Accordingly, the gap in which the electric wire 15 moves is reduced by a thickness of the wire tube 1 (refer to L2 of FIG. 7), and the reduction of the gap will function as shown in FIG. 8 even if the electric wire 15 is bent.

Figure 8:
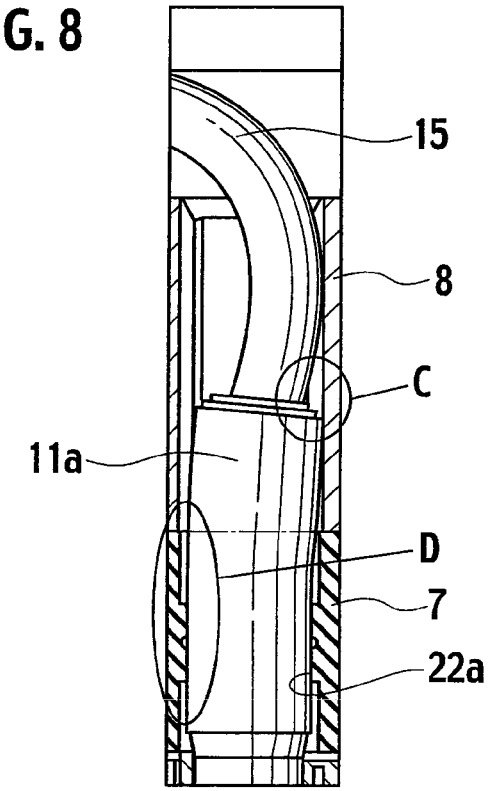
FIG. 8 is a second cross-sectional view showing the function of the waterproof connector according to the embodiment of the present invention.

As shown in FIG. 8, in the case where the electric wire 15 is bent, the rear side end portion of the wire tube 11 will be thrust against the rear grid 8 (refer to a portion C of FIG. 8). In this case, the rear side end portion of the wire tube 11 does not dig into the mat seal 7, and the gap between the wire tube 11 and the large terminal insertion opening 21*a* becomes less likely to occur (refer to a portion D of FIG. 8). Specifically, in the conventional waterproof connector, the rear side end portion of the wire tube 100 abuts on the mat seal as an elastic member, the rear side end portion largely deforms the terminal insertion portion 101 of the mat seal in the case where the electric wire 103 located in the rear of the rear grid is bent. However, in the waterproof connector 1 according to this embodiment, since the rear side end portion of the wire tube 11 abuts on the rear grid 8, the rear side end portion does not dig into the mat seal 7, thus making it possible to prevent a situation where the large terminal insertion opening 21*a* is largely deformed.

Moreover, in the waterproof connector 1 according to this embodiment, since the rear side end portion of the wire tube 11 abuts on the rear grid 8, the rear side end portion does not dig into the mat seal 7, and a situation can be prevented, where the rear side end portion of the wire tube 11 is caught on the larger terminal insertion opening 23*a* to then make it difficult to pull out the large female terminal 5*a*. Furthermore, the wire tube 11 can be prevented from separating from the waterproof connector 1 at the time of pulling out the large female terminal 5*a*.

Figure 9:
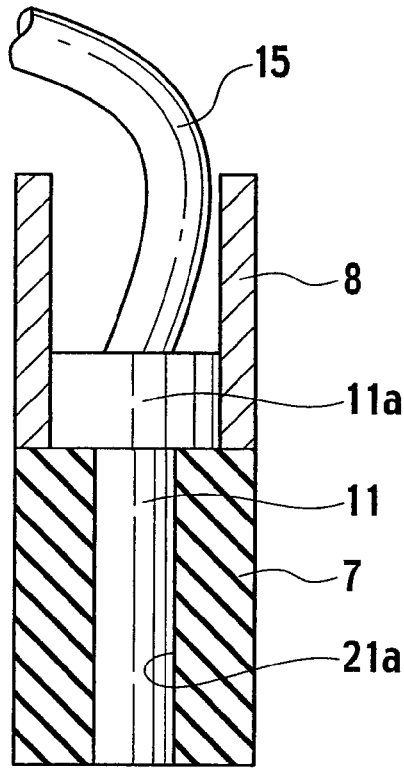
FIG. 9 is a cross-sectional view showing a first modification example of the wire tube.

Next, a description will be made of modification examples of the wire tube 11 according to this embodiment. FIG. 9 is a cross-sectional view showing a first modification example of the wire tube 11. As shown in FIG. 9, a diameter of a protruding portion 11*a* is increased more than diameters of other portions of the wire tube 11. Accordingly, rigidity of the protruding portion 11*a* is enhanced, and even if the electric wire 15 in the rear of the rear grid is bent, the wire tube 11 becomes less likely to be bent, whereby a deformation amount of the large terminal insertion opening 21*a* can be suppressed. Moreover, since the diameter of the protruding portion 11*a* is increased, the water can be further suppressed from entering the waterproof connector, whereby the waterproof performance can be enhanced.

Here, it is preferable that such an increased outer diameter of the protruding portion 11*a* be set at substantially the same as an inner diameter of the terminal insertion opening 23*a*. The reason for the above is as follows. In such a way as described above, movement of the wire tube 11 in a diameter direction is restrained, and even if the electric wire 103 in the rear of the rear grid is bent, the motion of the protruding portion 11*a* is restrained to an extreme extent, whereby the deformation amount of the large terminal insertion opening 21*a* can be suppressed.

Figure 10:
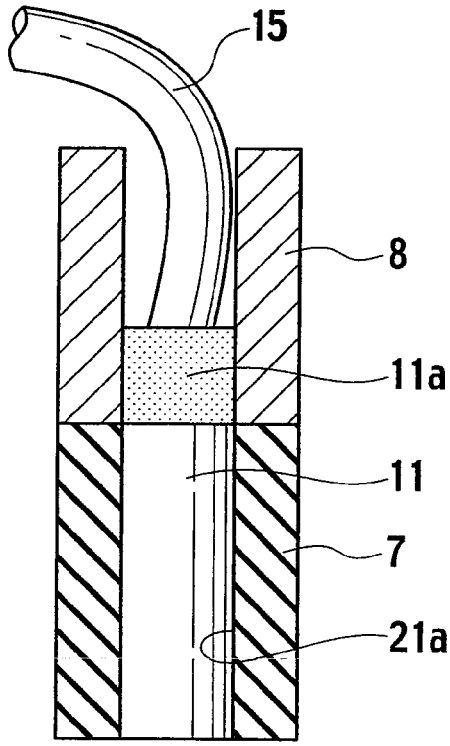
FIG. 10 is a cross-sectional view showing a second modification example of the wire tube.

In a second modification example, as shown in FIG. 10, the protruding portion 11*a* is formed of a material having higher rigidity than the other portions of the wire tube 11. As described above, the protruding portion 11*a* is formed of a material having higher rigidity than the other portions of the wire tube. Accordingly, even if the electric wire 15 in the rear of the rear grid is bent, the wire tube 11 becomes less likely to be deformed, whereby the deformation amount of the large terminal insertion opening 21*a* can be suppressed.

Here, it is preferable that the protruding portion 11*a* be formed of a material having a smaller friction coefficient than the other portions of the wire tube 11. The reason for this is as follows. In such a way as described above, force of pulling out the large female terminal 5*a* can be suppressed from becoming excessively large owing to friction between the protruding portion 11*a* and the rear grid 8 at the time of pulling out the large female terminal 5*a*. In particular, in the case where the entirety of the wire tube 11 is formed of the material having the small friction coefficient, friction force between the wire tube 11 and the mat seal 7 is decreased, and the possibility that the wire tube 11 may separate from the waterproof connector is increased; however, such a situation can be suppressed when only the protruding portion 11*a* is formed of the material having the small friction coefficient.

Note that the protruding portion 11*a* formed of the different material as described above may be molded integrally with the other portions of the wire tube 11, or may be joined to the other portions of the wire tube 11 after being molded as a different body.

Figure 11:
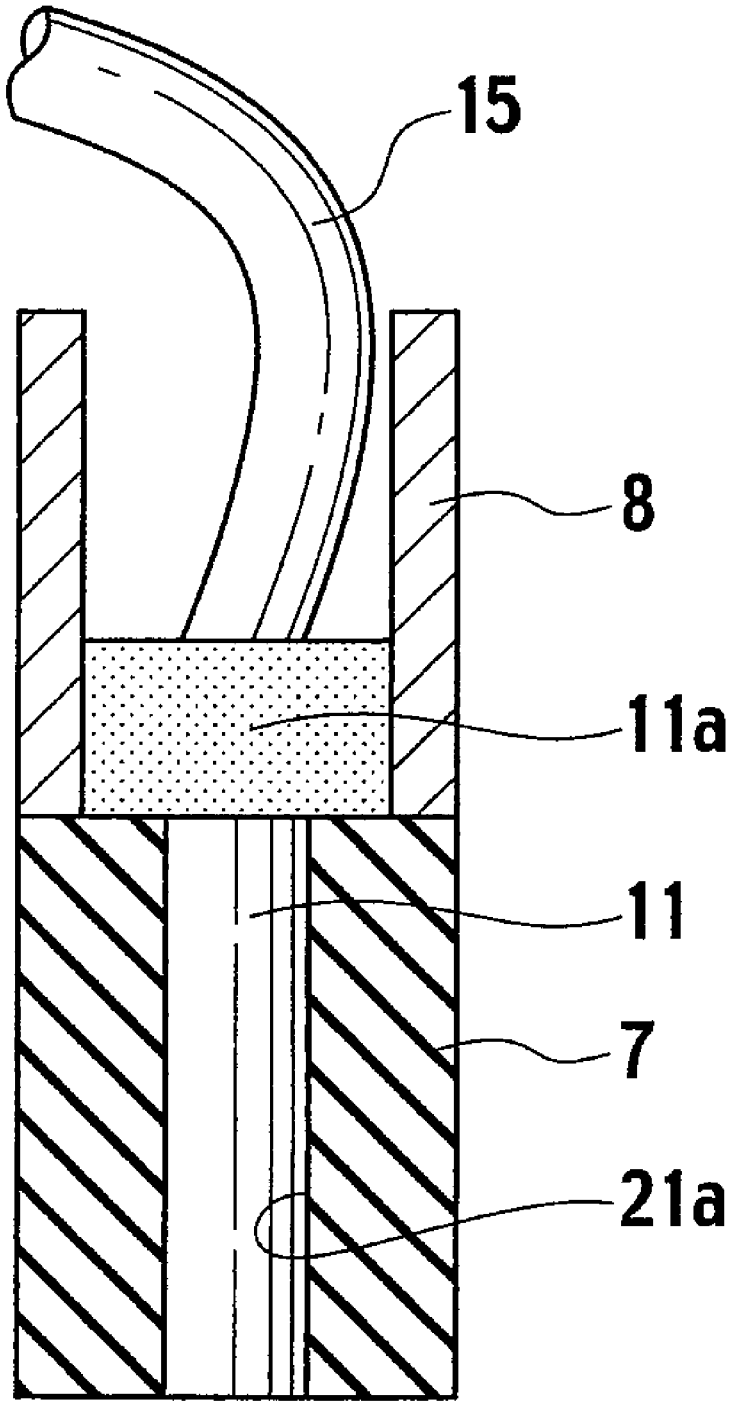
FIG. 11 is a cross-sectional view showing a third modification example of the wire tube.

In a third modification example, a wire tube 11 shown in FIG. 11 is a tube formed by combining features of the respective wire tubes 11 shown in FIG. 9 and FIG. 10. Specifically, a protruding portion 11*a* in FIG. 11 is formed so that the diameter thereof can be increased more than the diameters of the other portions of the wire tube 11, and is formed of the material having the higher rigidity and the smaller friction coefficient than the other portions of the wire tube 11. In such a way, the waterproof performance can be increased while suppressing the deformation amount of the large terminal insertion opening 21*a*, and the situation where the force of pulling out the large female terminal 5*a* becomes excessively large can be suppressed.

As described above, in accordance with the waterproof connector 1 according to this embodiment, the wire tube 11 includes the protruding portion 11*a* protruding rearward from the large terminal insertion opening 21*a* of the mat seal 7. Accordingly, even if the electric wire 15 in the rear of the rear grid is bent, the rear side end portion of the wire tube 11 will be thrust against the rear grid 8, and the situation can be prevented, where the rear side end portion is thrust against the mat seal 7, and the large terminal insertion opening 21*a* of the mat seal 7 is deformed largely. Moreover, the rear side end portion of the wire tube 11 is prevented from being thrust against the mat seal 7, and accordingly, the rear side end portion is prevented from digging thereinto, and the situation where such an end portion is caught on the rear grid 8 at the time of pulling out the large female terminal 5*a* can be prevented. Hence, even if the electric wire 15 is bent, sealing properties between the electric wire and the mat seal can be ensured, and it is prevented from becoming difficult to pull out the large female terminal 5*a*, and further, the wire tube 11 can be prevented from separating from the waterproof connector at the time of pulling out the large female terminal 5*a*.

Moreover, in accordance with this embodiment, the diameter of the protruding portion 11*a* is increased more than the diameters of the other portions of the wire tube 11. Accordingly, the rigidity of the protruding portion 11*a* is enhanced. In such a way, even if the electric wire 15 in the rear of the rear grid is bent, the wire tube 11 becomes less likely to be deformed, whereby the deformation amount of the large terminal insertion opening 21*a* can be suppressed. Moreover, since the diameter of the protruding portion 11*a* is increased, the water can be further suppressed from entering the waterproof connector, whereby the waterproof performance can be enhanced.

Furthermore, in accordance with this embodiment, the protruding portion 11*a* is formed of the material having the higher rigidity than the other portions of the wire tube 11. Accordingly, even if the electric wire 15 in the rear of the rear grid is bent, the wire tube 11 becomes less likely to be deformed, whereby the deformation amount of the large terminal insertion opening 21*a* can be suppressed.

Still further, in accordance with this embodiment, the protruding portion 11*a* is formed of the material having the smaller friction coefficient than the other portions of the wire tube 11. Therefore, the force of pulling out the large female terminal 5*a* can be suppressed from becoming excessively large owing to the friction between the protruding portion 11*a* and the rear grid 8 at the time of pulling out the large female terminal 5*a*. In particular, in the case where the entirety of the wire tube 11 is formed of the material having the small friction coefficient, the friction force between the wire tube 11 and the mat seal 7 is decreased, and the possibility that the wire tube 11 may separate from the waterproof connector is increased; however, such a situation can be suppressed when only the protruding portion 11*a* is formed of the material having the small friction coefficient.

The description has been made above of the present invention based on the embodiment; however, the present invention is not limited to the above-described embodiment, and alterations may be added thereto within the scope without departing from the spirit of the present invention. For example, though the female terminals 5 are stored in the terminal receiving chambers 18 of the connector housing 6 in the above-described embodiment, the present invention is not limited to this, and a configuration may be adopted, in which the male terminals are stored in the terminal receiving chambers 18.

Moreover, though the inner diameter of each of the large electric wire insertion openings 23*a* of the rear grid 8 is made larger than the outer diameter of each of the wire tubes 11 in the above-described embodiment, both of the diameters may be substantially equal to each other. The reason for this is as follows. In such a way as described above, the gap in which the electric wire 15 moves can be further reduced, and the gap between the wire tube 11 and the large terminal insertion opening 21*a* can be reduced.

Furthermore, in the above-described embodiment, the wire tube 11 is fitted to the electric wire 15 to which the large female terminal 5*a* crimped; however, the present invention is not limited to this, and the wire tube 11 may be fitted to the electric wire 15 to which the small female terminal 5*b* is crimped.

What is claimed is:

1. A waterproof connector, comprising;

a connector housing fitted to a corresponding connector, the connector housing including a terminal receiving chamber that receives a terminal fitting;

a mat seal having a terminal insertion opening formed at a position corresponding to the terminal receiving chamber of the connector housing, the mat seal being attached to rear of the connector housing when viewed from the corresponding connector;

a rear grid having an electric wire insertion opening formed at a position corresponding to the terminal insertion opening of the mat seal, the rear grid being attached from more rearward of the mat seal to a rear side of the connector housing to which the mat seal is attached; and a wire tube having a protruding portion, fitted to an electric wire having the terminal fitting attached thereto, and brought into elastically intimate contact with an inner wall of the terminal insertion opening of the mat seal, wherein the protruding portion is located in the electric wire insertion opening, and protrudes rearward from the terminal insertion opening of the mat seal.

2. The waterproof connector according to claim 1, wherein a diameter of the protruding portion is larger than diameters of other portions of the wire tube.

3. The waterproof connector according to claim 1, wherein the protruding portion is formed of a material having higher rigidity than other portions of the wire tube.

4. The waterproof connector according to claim 1, wherein the protruding portion is formed of a material having a smaller friction coefficient than other portions of the wire tube.

5. The waterproof connector according to claim 1, wherein an inner wall of the electric wire insertion opening is formed so as to abut the electric wire when being bent.

6. The waterproof connector according to claim 1, wherein the mat seal is flatly formed and includes; a bag-'like skin made of an elastic material; and a gel-state silicon resin into the skin.

* * * * *